US009616285B2

(12) United States Patent
Todd et al.

(10) Patent No.: US 9,616,285 B2
(45) Date of Patent: Apr. 11, 2017

(54) CORE EXERCISE APPARATUS AND METHODS

(71) Applicant: Nordic Capital Partners LLC, Plymouth, MN (US)

(72) Inventors: Terri Todd, Chittenango, NY (US); Byron Tietjen, Baldwinsville, NY (US)

(73) Assignee: InertiaCore Training Systems LLC, Baldwinsville, NY (US)

( * ) Notice: Subject to any disclaimer, the term of this patent is extended or adjusted under 35 U.S.C. 154(b) by 0 days.

(21) Appl. No.: 14/173,606

(22) Filed: Feb. 5, 2014

(65) Prior Publication Data

US 2015/0038301 A1 Feb. 5, 2015

Related U.S. Application Data

(63) Continuation-in-part of application No. 13/685,968, filed on Nov. 27, 2012.
(Continued)

(51) Int. Cl.
*A63B 21/08* (2006.01)
*A63B 69/06* (2006.01)
(Continued)

(52) U.S. Cl.
CPC ..... *A63B 23/0216* (2013.01); *A63B 21/0615* (2013.01); *A63B 21/0616* (2015.10);
(Continued)

(58) Field of Classification Search
CPC ..... A63B 21/1492; A63B 2208/0233; A63B 23/0211; A63B 21/0004; A63B 21/00116;
(Continued)

(56) References Cited

U.S. PATENT DOCUMENTS 478,166 A * 7/1892 Madsen ..... 482/146
2,719,571 A * 10/1955 Taylor ..... 248/371
(Continued)

OTHER PUBLICATIONS

Website, PaddleOne Canoe and Kayak Paddling Simulators, Superior Surf Systems, www.superiorsurfsystems.com/a/j/component/content/article/45, 3 pgs., Dec. 27, 2012.

*Primary Examiner* — Joshua Lee

(74) *Attorney, Agent, or Firm* — Craige Thompson; Thompson Patent Law

(57) ABSTRACT

A dual-mode exercise apparatus may include an articulating arm assembly coupled through a joint to a support assembly. In an illustrative embodiment, the arm assembly may include a seat centrally mounted above a ball-and-socket joint and a stabilizer member for the hands and/or feet of the user. In a first mode of operation a user sits on the seat and uses his or her core muscles to articulate the seat on the ball-and-socket joint against the resistance provided by, for instance, weights mounted on distal portions of the arm assembly. In certain embodiments the apparatus may further provide a second mode of operation which simulates rowing a kayak. In a corresponding illustrative embodiment a user sits in a second seat positioned rearward of the arm assembly and the arm assembly includes handle members. In operation the user articulates the handles in a manner akin to rowing a kayak.

5 Claims, 11 Drawing Sheets

Related U.S. Application Data

(60) Provisional application No. 61/760,832, filed on Feb. 5, 2013, provisional application No. 61/911,344, filed on Dec. 3, 2013.

(51) Int. Cl.

| | |
|---|---|
| ***A63B 21/06*** | (2006.01) |
| ***A63B 21/062*** | (2006.01) |
| ***A63B 21/00*** | (2006.01) |
| ***A63B 26/00*** | (2006.01) |
| ***A63B 23/02*** | (2006.01) |
| ***A63B 23/035*** | (2006.01) |
| ***A63B 23/12*** | (2006.01) |
| *A63B 69/04* | (2006.01) |
| *A63B 21/02* | (2006.01) |
| *A63B 21/055* | (2006.01) |
| *A63B 71/00* | (2006.01) |
| *A63B 71/06* | (2006.01) |

(52) U.S. Cl.

CPC ..... *A63B 21/4047* (2015.10); *A63B 23/0222* (2013.01); *A63B 23/0227* (2013.01); *A63B 23/03533* (2013.01); *A63B 23/1263* (2013.01); *A63B 21/023* (2013.01); *A63B 21/055* (2013.01); *A63B 21/4033* (2015.10); *A63B 69/04* (2013.01); *A63B 2069/068* (2013.01); *A63B 2071/0063* (2013.01); *A63B 2071/0655* (2013.01); *A63B 2071/0694* (2013.01); *A63B 2208/0233* (2013.01); *A63B 2220/10* (2013.01); *A63B 2220/24* (2013.01); *A63B 2220/30* (2013.01); *A63B 2220/51* (2013.01)

(58) Field of Classification Search

CPC ... A63B 21/0615; A63B 22/18; A63B 22/205; A63B 23/0216; A63B 23/0227; A63B 23/03583

USPC ..... 482/44–51, 72, 77–80, 92–98, 100–101, 482/110, 131–140, 143, 145–148; 297/195.1, 215.13–215.15, 258.1–272.4, 297/311–344.26; 472/95–97, 100, 102, 472/135; 434/247

See application file for complete search history.

(56) References Cited

U.S. PATENT DOCUMENTS

| | | | | |
|---|---|---|---|---|
| 4,186,920 | A * | 2/1980 | Fiore et al. | 482/79 |
| 4,605,220 | A * | 8/1986 | Troxel | 482/79 |
| 4,605,334 | A * | 8/1986 | Kalvatn | 403/291 |
| 4,641,833 | A * | 2/1987 | Trethewey | 482/95 |
| 5,385,154 | A * | 1/1995 | Fuhrman et al. | 128/845 |
| 5,728,049 | A * | 3/1998 | Alberts | 601/24 |
| 6,022,303 | A * | 2/2000 | Abdo | 482/140 |
| 6,053,578 | A * | 4/2000 | van Hekken et al. | 297/411.35 |
| 6,264,588 | B1 * | 7/2001 | Ellis | 482/137 |
| 6,379,289 | B1 * | 4/2002 | Gossie | 482/142 |
| 6,485,398 | B1 * | 11/2002 | Kreft | 482/94 |
| RE38,057 | E * | 4/2003 | Pandozy | 482/97 |
| 6,666,802 | B1 * | 12/2003 | Rasmussen | 482/148 |
| 7,476,188 | B2 * | 1/2009 | Perez, Jr. | 482/142 |
| 7,594,881 | B2 * | 9/2009 | Shifferaw | 482/142 |
| 8,172,732 | B1 * | 5/2012 | Webber et al. | 482/97 |
| 2005/0101460 | A1 * | 5/2005 | Lobban | 482/140 |
| 2009/0230743 | A1 * | 9/2009 | Derakhshan et al. | 297/329 |
| 2010/0009818 | A1 * | 1/2010 | Simonson et al. | 482/97 |
| 2011/0301002 | A1 * | 12/2011 | Sebastian | 482/140 |
| 2012/0065036 | A1 * | 3/2012 | Abercrombie, Jr. | 482/139 |

* cited by examiner

CORE EXERCISE APPARATUS AND METHODS

CROSS-REFERENCE TO RELATED CASES

The instant application is a continuation-in-part of application Ser. No. 13/685,968, entitled Core Exercise Apparatus and Methods, filed Nov. 27, 2012 and claims benefit to provisional application Ser. No. 61/760,832, entitled Core Exercise Apparatus and Methods, filed Feb. 5, 2013, and provisional application Ser. No. 61/911,344, entitled InertiaCore Board Trainer, filed Dec. 3, 2013. The entirety of each of the foregoing priority applications is hereby incorporated by reference.

SUMMARY OF ILLUSTRATIVE EMBODIMENTS

A dual-mode exercise apparatus may include an articulating arm assembly coupled through a joint to a support assembly. In an illustrative embodiment, the arm assembly may include a seat centrally mounted above a ball-and-socket joint and a stabilizer member for the hands and/or feet of the user. In a first mode of operation a user sits on the seat and uses his or her core muscles to articulate the seat on the ball-and-socket joint against the resistance provided by, for instance, weights mounted on distal portions of the arm assembly. In certain embodiments the apparatus may further provide a second mode of operation which simulates rowing a kayak. In a corresponding illustrative embodiment a user sits in a second seat positioned rearward of the arm assembly and the arm assembly includes handle members. In operation the user articulates the handles in a manner akin to rowing a kayak.

The details of one or more implementations are set forth in the accompanying drawing and description below. Other features, objects, and advantages will be apparent from the description and drawings, and from the claims.

BRIEF DESCRIPTION OF FIGURES

Like reference symbols in various drawing indicate like elements.

DETAILED DESCRIPTION OF ILLUSTRATIVE IMPLEMENTATIONS

Figure 1:
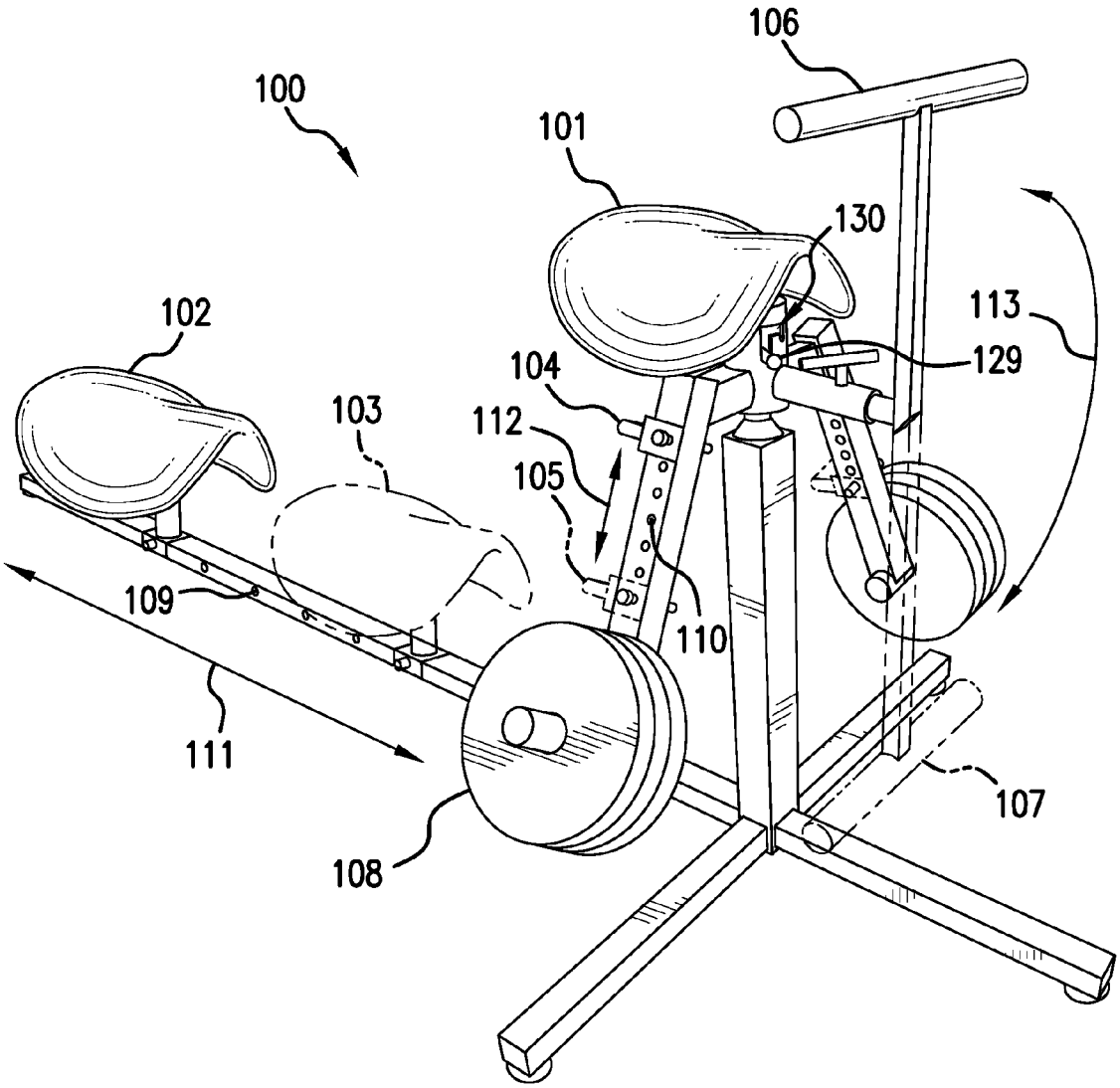
FIG. 1 is a perspective view of an illustrative core training apparatus.

FIG. 1 is a perspective view of an illustrative core training apparatus. FIG. 1 depicts a core training apparatus 100 which includes a support base that includes laterally extending support arms. The rearwardly extending arm is longer than the remaining three arms and slidably engages seat 102 which is secured in a desired position along the rearwardly extending arm with a pin that mates with one of a number of receiving apertures 109 located along the rearwardly extending arm. The seat 102 can be moved as shown by arrow 111 into various positions (e.g., as depicted in broken lines by a seat 103) along the rearwardly extending arm defined by pin receiving holes 109.

The support base also includes a vertically extending member which includes a ball member akin to that conventionally used as vehicular trailer hitches. Atop that ball member is mounted a center post which includes a seat 101 opposite a socket member with a recess into which the ball is received. In certain embodiments the socket member has one or more inwardly projecting locking mechanisms such as set screws which prevent the socket from lifting off of the ball. In the depicted example, the center post includes a locking pin 129 extending radially through a slot 130 in the center post. Examples of locking pin mechanisms are described in further detail with reference, for example, to at least FIG. 6. As depicted here, the locking pin 129 is in a lower position, which may correspond to the center post being in a locked state to prevent movement of the center post with respect to the ball. This locked state may provide, in some embodiments, a stable seat 101, for example, when a user mounts or dismounts from the seat 101.

Extending forwardly from the center post is a member that supports a handlebar/footrest 106. As shown by arrow 113 the handlebar/footrest 106 can articulate between an upper position in which the member serves as a handlebar and a lower position (e.g., as depicted in broken lines in the position as a footrest 107) in which the member serves as a footrest. In the depicted example, the handlebar/footrest 106 is locked into the desired position with a spring loaded reciprocating pin.

Extending laterally from the center post are downwardly projecting arms which have handles 104 slideably mounted thereto. The handles 104 can be moved as shown by arrow 112 into various positions (e.g., as depicted in broken lines by handles 105) along the arms defined by pin receiving holes 110. At the distal (lower) ends of the downwardly projecting arms are ballast holding posts that project perpendicularly and laterally from the arms. The posts are configured to receive plates 108 that provide weight which is subject substantially to gravitational and inertial forces. In operation, the user may perform static and/or dynamic exercises by generating forces that overcome resistance associated with the gravitational and/or inertial forces on the ballast(s), such as the plates 108, for example.

Figure 2:
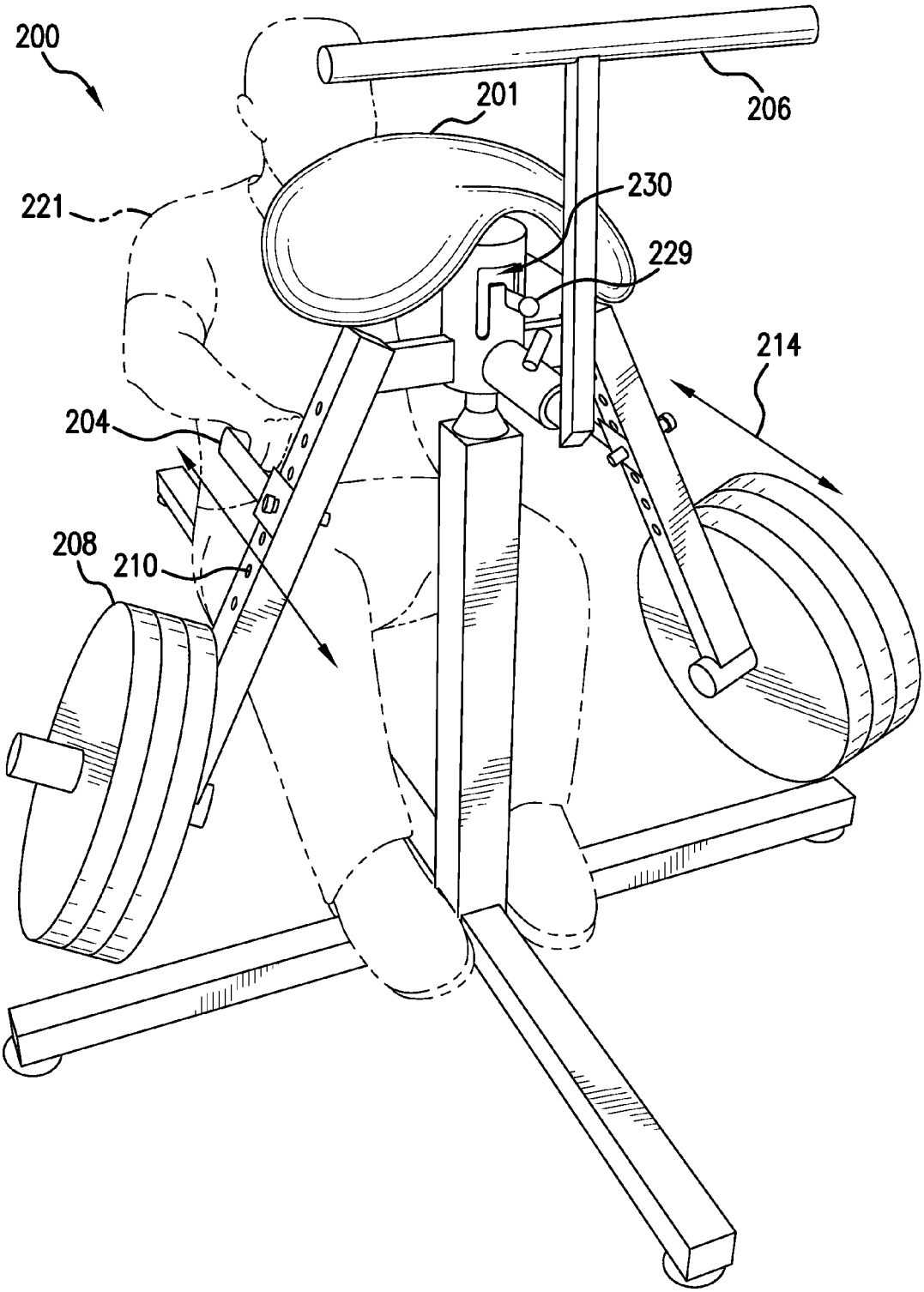
FIG. 2 is a perspective view of the illustrative core training apparatus which depicts a first operational mode.

FIG. 2 is a perspective view of the illustrative core training apparatus which depicts a first operational mode. As depicted, FIG. 2 shows an operational mode in which a user 221 performs a rowing exercise. The user 221 sits on the rearwardly extending arm and places his hands on the handles 204 and pulls one back while permitting the other to move forward in a motion similar to rowing a kayak with a dual-ended paddle. Viewed from the sides, the handles 204 progress through an oval-shaped range of motion. In other exercises the handles 204 may be articulated horizontally back and forth as shown by arrows 214. The handles 204 may be positioned at different heights to alter the difficulty, the range of motion and the muscles exercised. Examples of illustrative motion trajectories are described in further detail with reference, for example, to FIG. 5.

In the depicted example, the center post includes a locking pin 229 extending radially through a slot 230 in the center post. As depicted here, the locking pin 129 is in a raised position, which may correspond to the center post being in an unlocked state to permit movement of the center post with respect to the ball. This unlocked state may provide, in some embodiments, an articulating assembly coupled to the center post rotatably supported by the ball, for example, responsive to user applying dynamic forces via the handles 204, for example. In various embodiments, the seat 201 remains fixed when locked by the locking pin 229, and otherwise the seat 201 is able to move freely subject primarily to gravitational and inertial forces on the ballast 208.

Figure 3A:
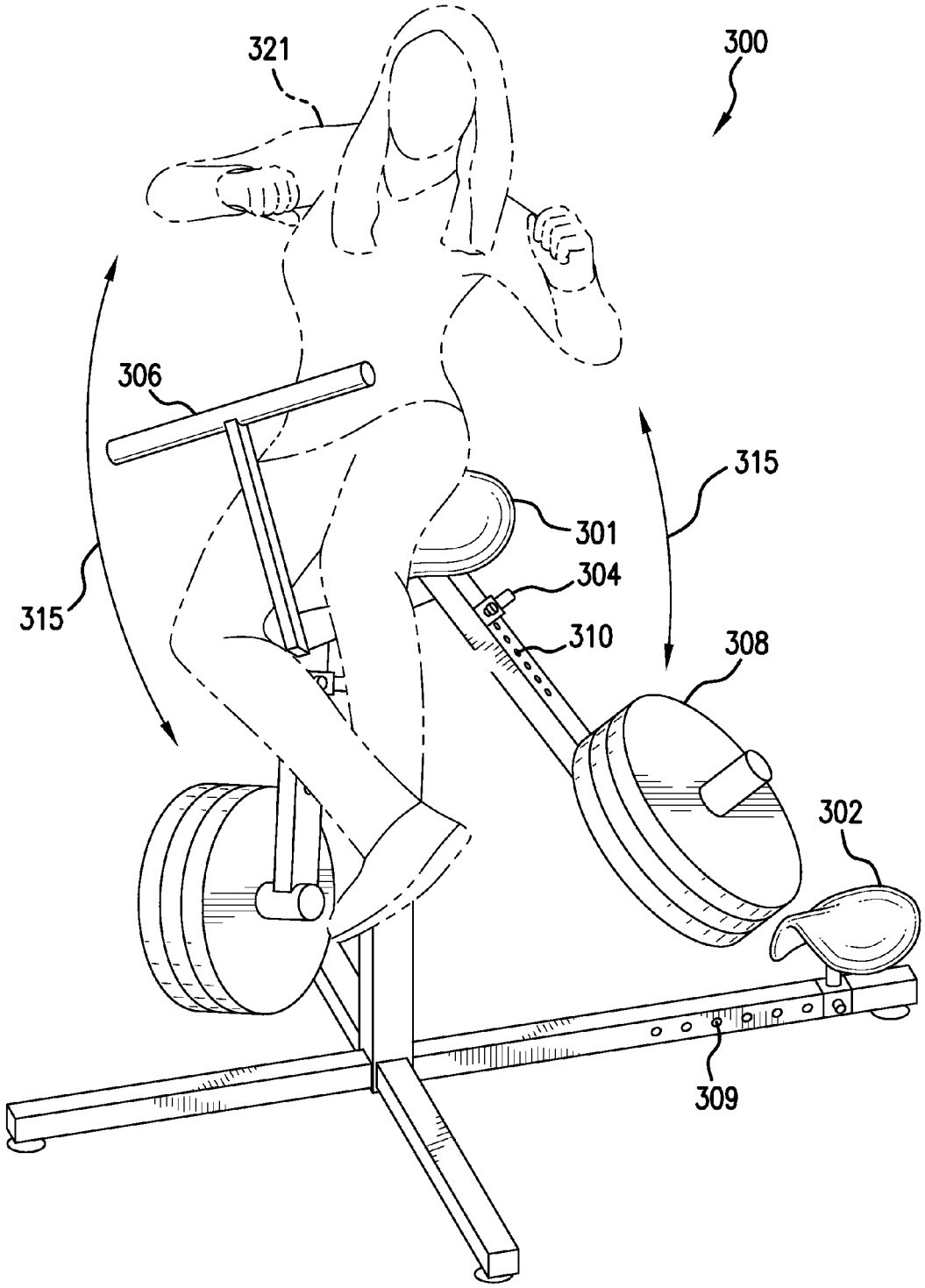
FIG. 3A is a perspective view of the illustrative core training apparatus which depicts a second operational mode.
Figure 3B:
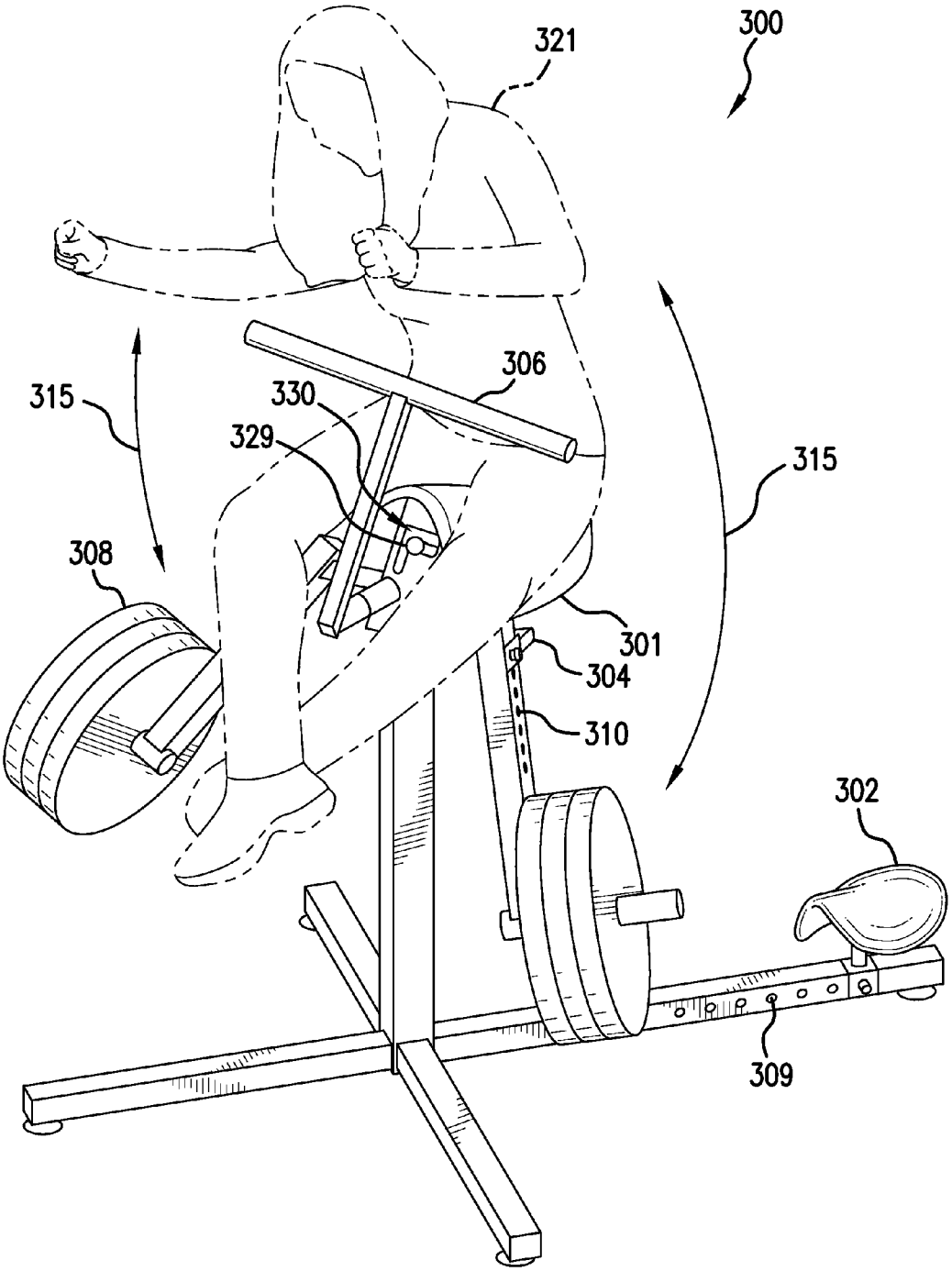
FIG. 3B is a perspective view of the illustrative core training apparatus which further depicts the second operational mode.

FIGS. 3A-3B show another operational mode in which a user sits atop the seat 301 and articulates the arm assembly through use of her core muscles. In this embodiment the handlebar/footrest 306 is secured into an upper position. The user pivots her upper torso relative to her lower torso in order to articulate the apparatus in a side-to-side motion illustrated by arrows 315. FIG. 3A illustrates a point in the range of motion in which the apparatus is fully articulated to the user's left hand side. FIG. 3B illustrates a point in the range of motion in which the apparatus is articulated to the user's right-hand side.

Figure 4A:
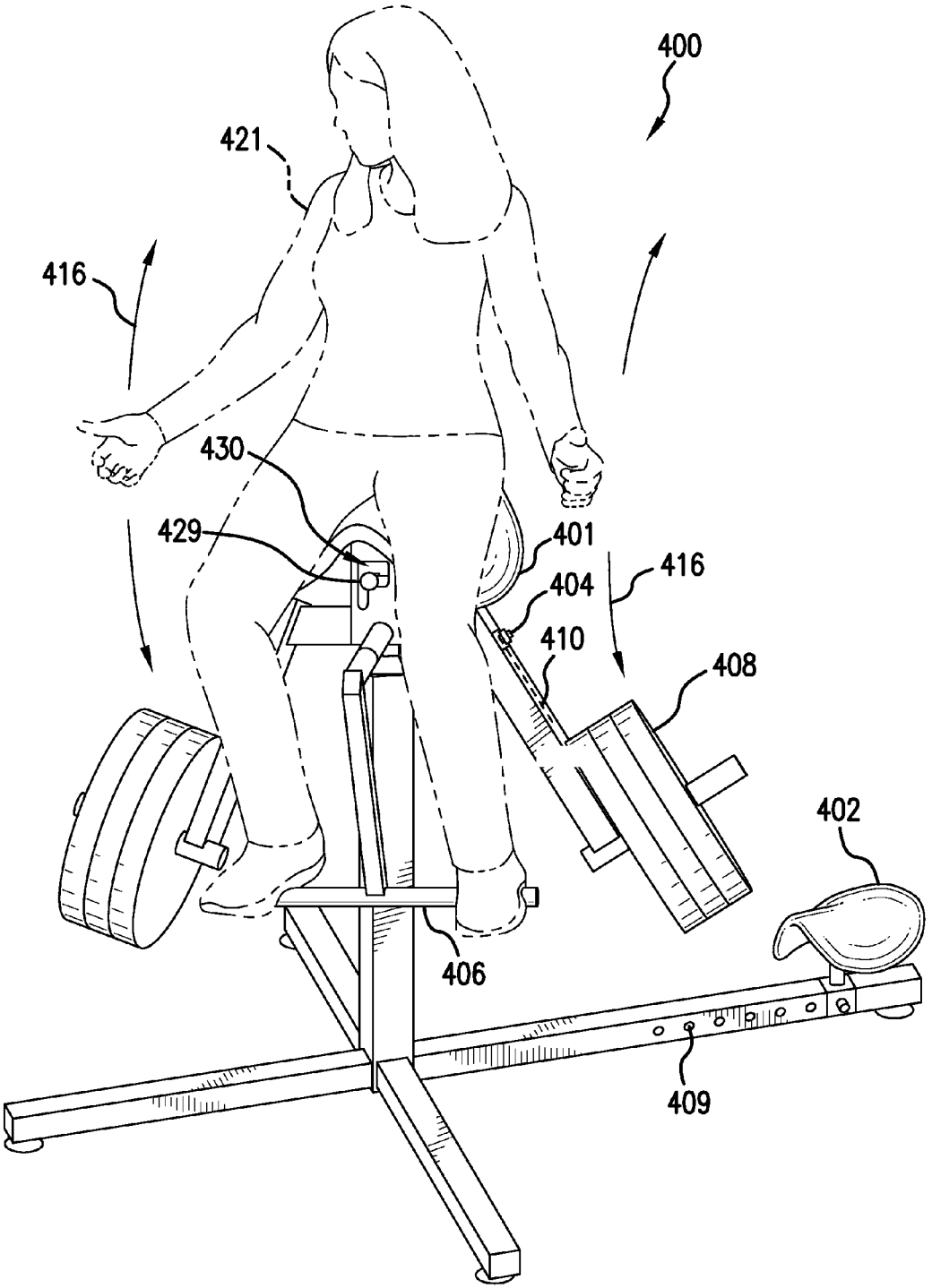
FIG. 4A is a perspective view of the illustrative core training apparatus which depicts a third operational mode.
Figure 4B:
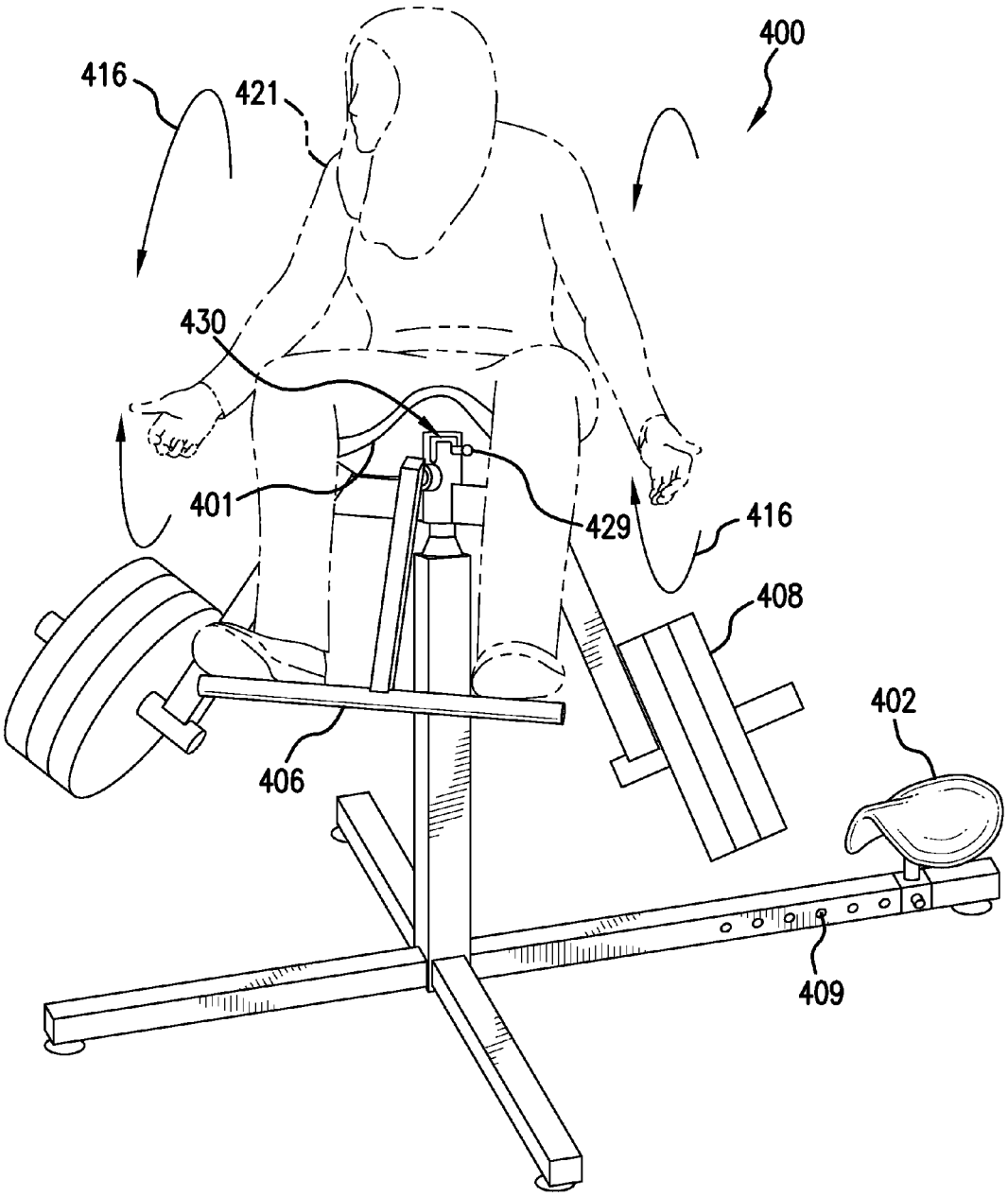
FIG. 4B is a perspective view of the illustrative core training apparatus which further depicts the third operational mode.

FIGS. 4A-4B show another operational mode in which a user sits atop the seat 401 and articulates the arm assembly through use of her core muscles. In this embodiment the handlebar/footrest 406 is secured into a lower position and the user's feet rest on the footrest 406. The user pivots her upper torso relative to her lower torso in order to articulate the apparatus in a front-to-back motion illustrated by arrows 416. FIG. 4A illustrates a point in the range of motion in which the apparatus is articulated to the front (taking the user as the frame of reference). FIG. 4B illustrates a point in the range of motion in which the apparatus is articulated to the rear (again, taking the user as the frame of reference).

Figure 5:
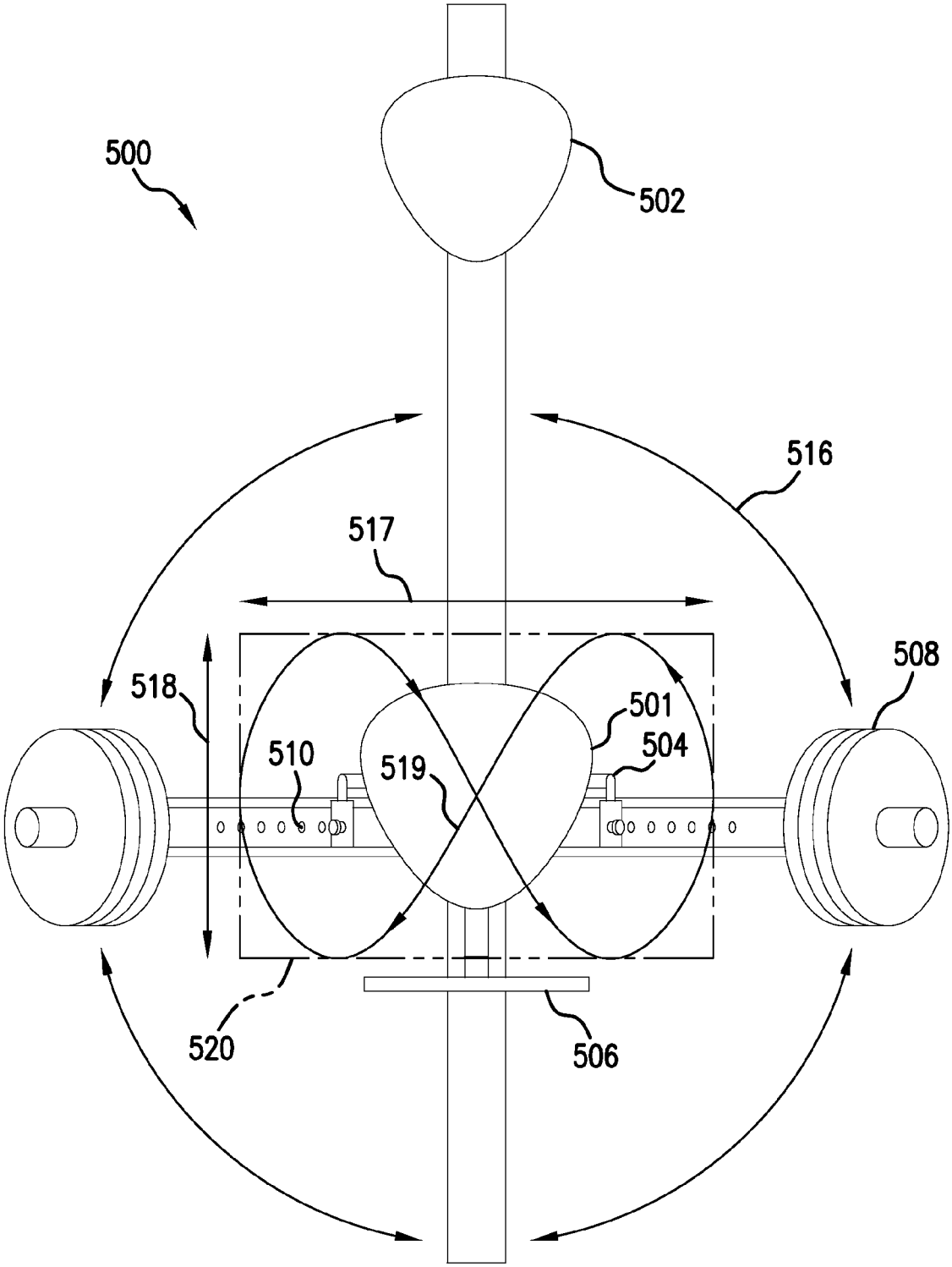
FIG. 5 is a plan view of an illustrative core training apparatus which depicts various operational modes.

FIG. 5 is a plan view of the core training apparatus 500 which shows various alternative exercise motions similar to those illustrated in FIGS. 3 and 4. As an alternative to or in addition to the side-to-side and front-to-back motions shown in FIGS. 3 and 4, the user may articulate the apparatus through a figure eight motion 519. By way of example and not limitation, the user can also articulate the apparatus in a rectangular pattern 517/518 wherein the apparatus is not permitted to return to the center position but instead the apparatus is articulated along the outline of rectangle 520. The apparatus may also be articulated in a circular pattern 516, during which the apparatus is likewise not permitted to return to the center or neutral position (shown in FIG. 1) during the exercise.

Figure 6:
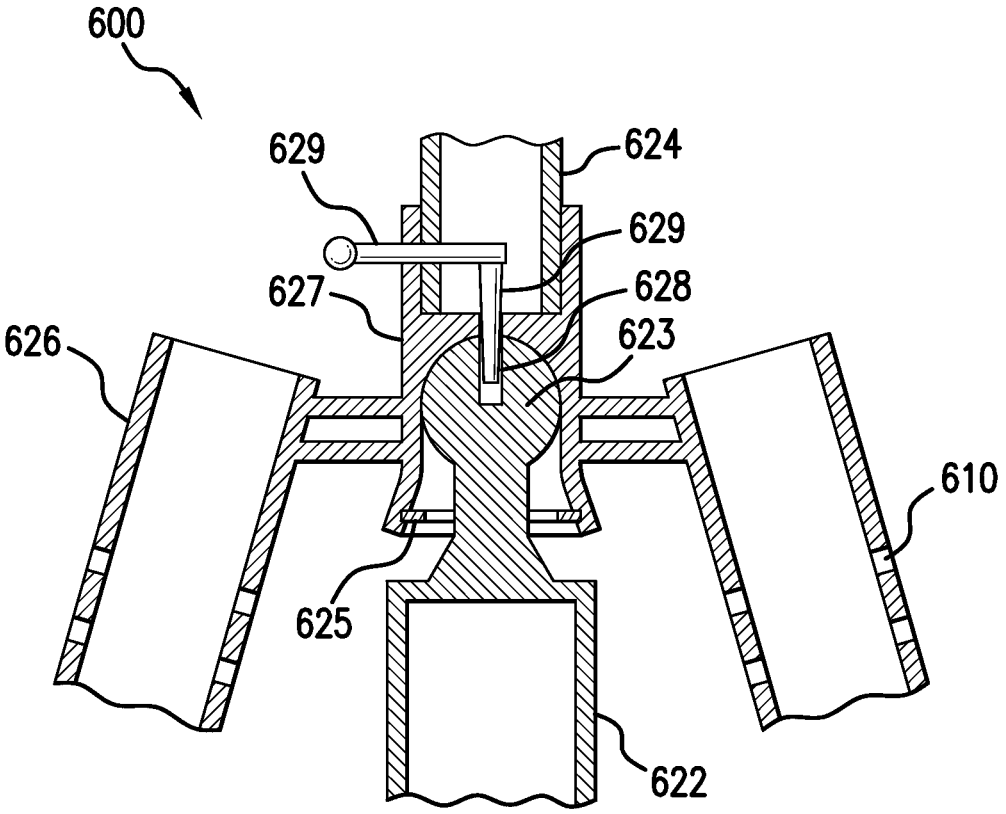
FIG. 6 is a front cross-sectional view of an exemplary angular coupling system in an illustrative core training apparatus.

FIG. 6 is a front cross-sectional view of an exemplary angular coupling system in an illustrative core training apparatus. An exemplary angular coupling system 600 for use in various embodiments of the core trainer and/or the row trainer includes a rigid support base member 622 having at a top end a ball 623. Movably coupled to the ball member 623 is a socket member 627, with a cup-shaped aperture to receive the ball member 623. The socket member is adapted to deflect around three orthogonal axes, for example, or other three dimensional coordinate axes, defined with respect to the ball 623. This motion can be restricted when a locking pin 629 is positioned in a locking channel 628 in the ball 623. The locking pin 629 position is controlled by a user-accessible lever. When retracted up so that the pin is clear of the locking channel 628, then relative movement of the socket member 627 relative to the ball 623 is not restricted by the pin 629. The user manipulation of the lever is guided by an L-shaped locking pin slot 130, as shown, for example, with reference to FIGS. 1-2.

The socket member is coupled to an actuating member 624, examples of which are described with reference to a center post with reference to FIG. 1. In the depicted example, laterally extending members 626 that support ballast (not shown) are integrally connected to the socket member 627.

In the depicted example, the socket member 627 receives a removable annular retaining ring 625 adjacent the opening of the aperture and proximate a neck region just below and supporting the ball 623 on the rigid base member 622. The retaining ring 625 has an inner diameter slightly less than an outer diameter of the ball 623 to prevent the socket member 627 from inadvertently decoupling from the ball 623, for example, during ballast changes, exercise, and mounting or dismounting operations.

Figure 7:
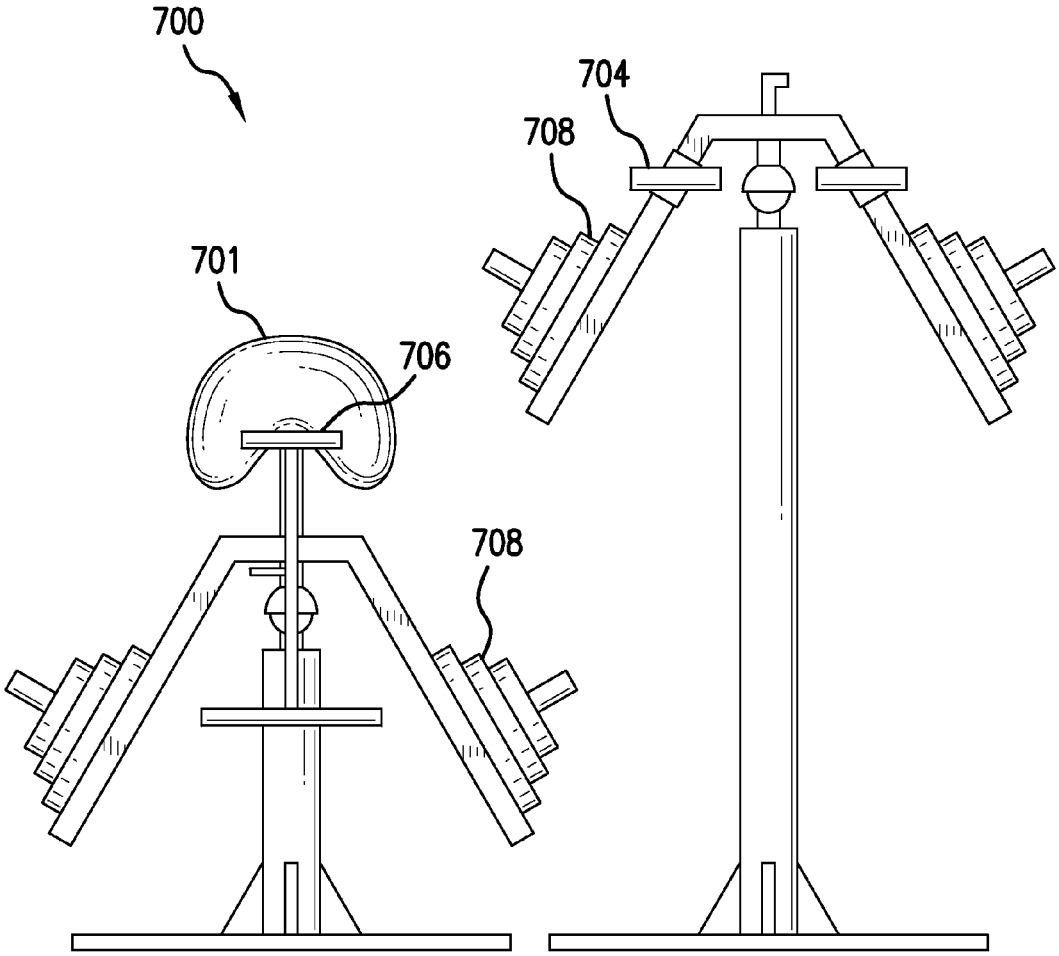
FIGS. 7-9 are front and side views of illustrative core training apparatus with illustrative row training apparatus.
Figure 8:
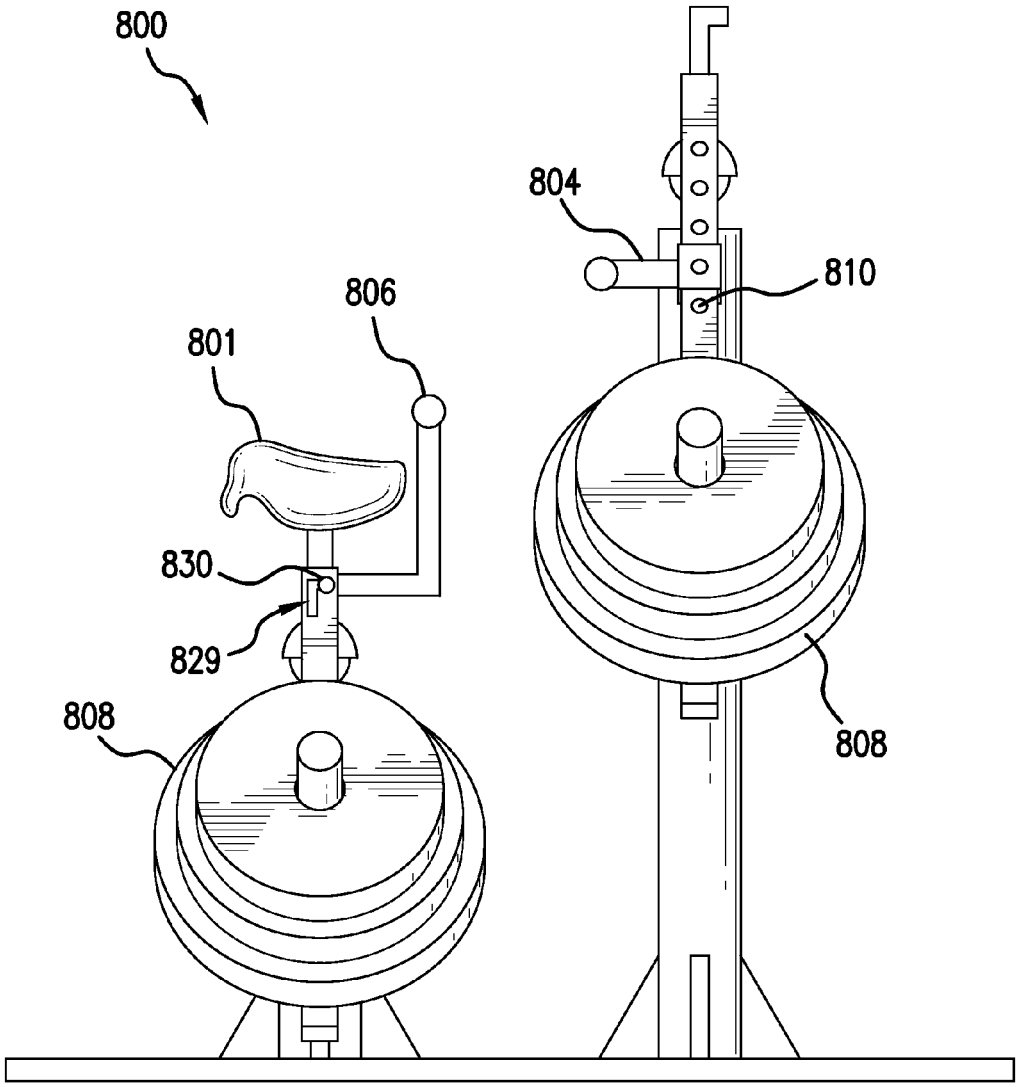
Figure 9:
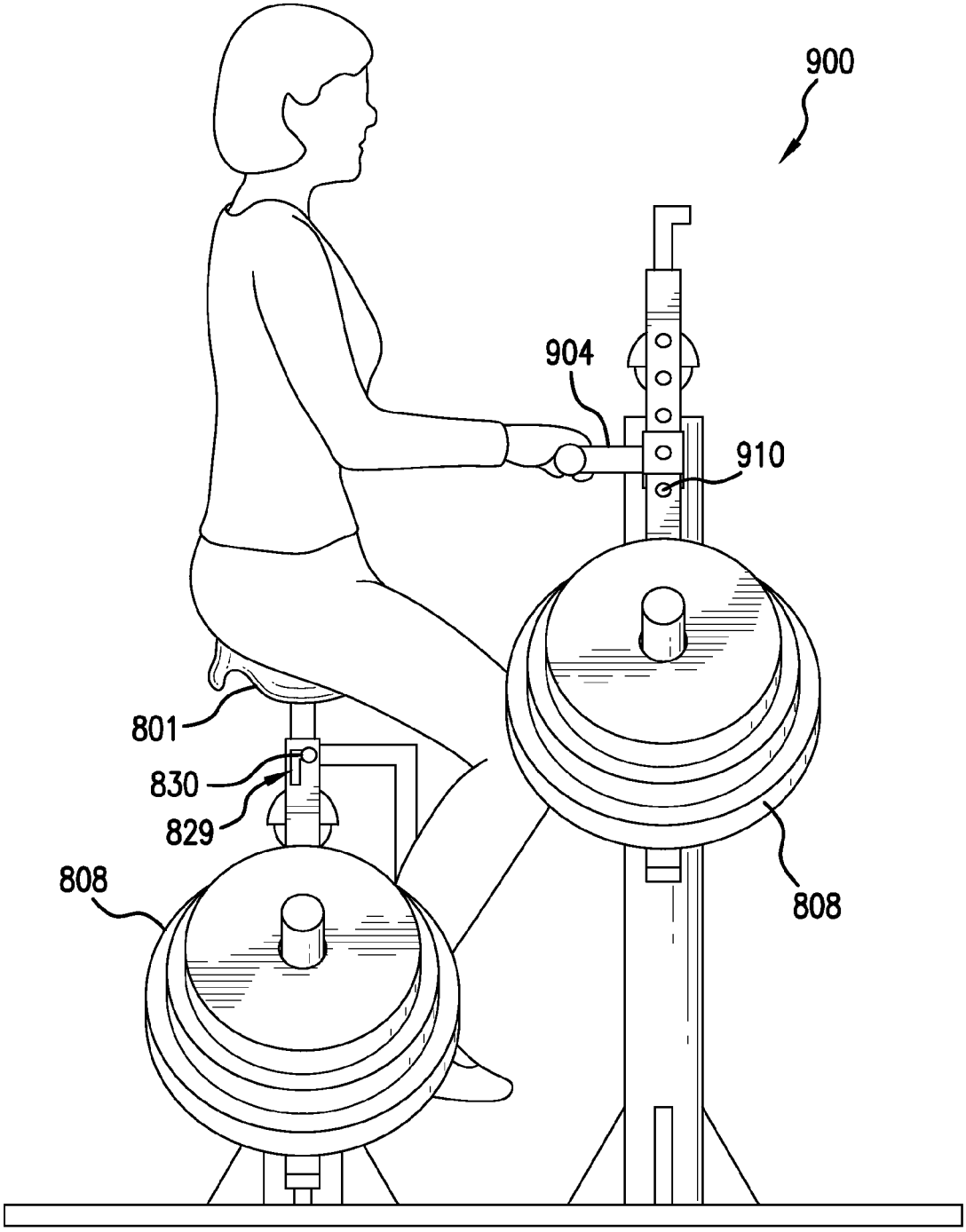

FIGS. 7-9 are front and side views of illustrative core training apparatus with illustrative row training apparatus. As depicted in FIG. 7, an exemplary exercise system includes a core trainer and a row trainer. The core trainer includes a seat 701 for a human user, and a dual handrest/footrest 706. Supported by an articulating assembly movably coupled to a ball joint are the seat 701 and opposing ballasts 708, which may provide controlled amounts of inertia and/or gravitational weight. In operation, the user exercises core muscles to impart motion profiles to the articulating assembly of the core trainer.

The row trainer as depicted includes an articulating rowing assembly movably coupled to a ball joint and opposing ballasts 708, which may provide controlled amounts of inertia and/or gravitational weight. In operation, the user grasps handles 704 and pulls and pushes to exercise, for example, upper body and/or core muscles to impart motion profiles to the articulating assembly of the row trainer.

FIG. 8 shows an exemplary exercise system with a locking pin 829 and locking pin slot 830 accessible from under the seat 801 on the right side of a user when seated on the seat 801. The pin 830 is shown in an upward retracted state, which corresponds to an unlocked state of the ball/socket. In this depicted example, the handrest 806 is positioned in an upper position for easy grasping by the user.

In the depicted example, the ballast of the core trainer is supported on posts that are coupled to opposing laterally extending members of a fixed length. In some other embodiments, the length of the laterally extending members may be adjustable.

The row trainer is positioned in front of the user seated on the seat 801, with handles 804 within reach of the user seated on the seat 801. By applying force via the handles 804, the user may cause motion of the articulating assembly that supports the ballast 808 on the row trainer. In this depicted example, the row trainer includes adjustable laterally extending members along which the user can adjust the handles 804. By adjusting the handles down, the user can select a wider separation between the left and right handles 804, for example. This adjustable separation of the handles 804 may advantageously accommodate different exercises and a range of user body sizes.

FIG. 9 illustrates an exemplary user seated on the core trainer and grasping the row trainer. The user has positioned the handrest/footrest 806 into a lower position for use as a footrest.

On the top of the row trainer is an L-shaped lever coupled to a locking pin for immobilizing the ball/socket on the row trainer, for example, during ballast changes. In the retracted state (as shown) the articulating assembly on the row trainer is free to be used for exercise. When rotated to be inserted into a locking channel in the ball, the row trainer articulating assembly may be locked. Examples of this operation are described in further detail with reference to FIG. 6.

Although various embodiments have been described with reference to the figures, other embodiments are possible. For example, the handles 104 may be positioned laterally outwards of the position shown in FIG. 1. In such an embodiment a laterally extending member couples each handle to the channel member which slideably engages the downwardly extending arms. In various embodiments the handles may be positioned approximately 2-4 feet apart, measured at the horizontal center point of each handle. In preferred embodiments the handles are approximately 2.5-3.5 feet apart, and in more preferred embodiments about 2.5 to 3 feet apart. In some embodiments, separation of the handles 104 may be adjustable to any of a number of user-selectable positions corresponding to a range of separation distances.

The horizontal offset of the handle from the downwardly extending arm may also be varied to alter the range of motion and muscles exercised. In the depicted embodiment the handles are offset by a distance of approximately 6 inches from the centerline of the downwardly extending arms. In other embodiments, this horizontal offset is approximately 8, 10, 12, 14, 16 or 18 inches.

Some embodiments may provide other grip styles and/or orientations for the handles 104, for example. For example, some implementations may include multiple or variable angle grip positions for the handles 104. Some embodiments may include a flexible (e.g., rope) attachment to be grasped by the user during exercise while seated on the seat 102.

Some examples may include foot placements to receive the ball, heel, toes, and/or the entire bottom surface of the foot of the user during exercise while seated on the seat 102. By way of example, and not limitation, the foot placements may include plates with or without straps to capture the top of each foot, or a bar member extending radially from the central base support member to provide a toe hold, for example.

To aid the loading and unloading of plates 108 from the plate holding posts the center post assembly may include a downwardly extending and reciprocating pin (e.g., the locking pin 129) which engages a vertical bore in the ball member. In this way the user can articulate the pin downward to lock the arm assembly in the center or neutral position during a plate unloading or loading operation and when mounting or dismounting the apparatus. When ready to begin an exercise movement, the user can articulate the pin upwards, thereby allowing the socket to rotate freely with respect to the ball.

The angle between the downwardly extending arms and vertical support post may be, in preferred embodiments, about 10-45 degrees and in more preferred embodiments about 15-25 degrees and in the most preferred embodiments about 15-20 degrees. This angle may also be manually adjustable by a user, as shown in the provisional applications incorporated herein by reference. In such embodiments the downwardly extending arms are hingedly coupled to the center post member and pins are used to secure the arms at the desired angle.

The apparatus may also include damper elements and/or tension spring elements that extend between the vertical support posts and either or both of the downwardly extending arms and the forwardly extending arm which holds the handlebar/footrest 106. Dampers may provide increased resistance at higher rates of motion and may also prevent the apparatus from pivoting quickly, thereby reducing the risk of injury during loading/unloading or mounting/dismounting operations. Tension spring elements will tend to cause the device to return to the center or neutral position and will thereby provide a substantially modified feel and exercise for the user. Either or both of the tension springs elements or the damper elements may be configured to be toollessly removable and installable so that a user can readily remove or add spring or damper elements as desired. For instance, the ends of the spring elements and damper elements may include apertures that align with complementary apertures on flanges disposed on the downwardly extending arms and the vertical support post so that a user may readily insert pins to secure each spring or damper element in place. Some embodiments may include an angular displacement sensor to detect the angular deflection of the articulating assembly, (e.g., the seat 101 or the row assembly), relative to a set of orthogonal axes defined by the articulating assembly's base member.

Some embodiments may further include sensors to detect position, velocity, and/or forces associated with static or dynamic exercises. In some examples one or more sensor assemblies may operate to detect the weight of the ballast loaded on the core trainer and/or the row trainer. Various sensor outputs may be received by a central processor executing a program of instructions for recording and communicating performance metrics and other feedback to the user. By way of example, and not limitation, the processor may be configured to send audible, visual, and/or tactile feedback to the user with indicia representative of athletic performance. For example, the processor may be coupled to a display device to display a plot of instantaneous and/or historical angular deflection of the articulating assemblies of the core trainer and/or the row trainer. The processor may output real time and/or historical averages or cumulative totals of user-selected parameters, such as revolutions per minute, number of revolutions, average angular deflection, calories expended, equivalent distance rowed in a kayak, or the like, for example. In some implementations, the display may provide a programmed display of training information, such as a pre-programmed series of motion profiles with deflection plots that the user should follow. The processor may provide a score based on the user's exercise performance variance with respect to the training profile. Increasing levels of difficulty may be associated with increased angular deflections, faster velocities, alone or in combination with more taxing motion profile sequences.

The features of the foregoing embodiments can be combined as desired to achieve additional embodiments. For instance, the core chair exercise device of FIG. 9 can be modified to include the non-pivoting seat and corresponding handles of FIG. 1, such the that the user can optionally sit in this additional seat, rearward of seat 801, to execute a rowing exercise using ballast 808 while seated in a position close to the floor.

A skilled artisan will understand that the motion of the core trainer and row trainer devices described herein will be subject substantially only to the gravitational and inertial forces acting upon and through the ballast. The shear friction associated with the ball joint interface is minimal in the preferred embodiments. The effect of mass of the device itself, as opposed to the ballast, will be in most embodiments be insignificant relative to the effect of the mass of the ballast given the positioning of the ballast and the associated polar moment of inertia.

A number of embodiments have been described. Nevertheless, it will be understood that various modifications are optionally made without departing from the spirit and scope of this disclosure. Accordingly, other embodiments are within the scope of the following claims.

The invention claimed is:

1. A core exercise apparatus comprising:

a rigid base member having an upper end and a lower end;

a pivot mechanism coupled to the upper end of the base member, the pivot mechanism comprising a ball and socket joint positioned along a vertical axis;

a locking mechanism to prevent the pivot mechanism from pivoting when the locking mechanism is in an engaged position;

a first seat or platform mounted atop the pivot mechanism such that the user support is able to freely pivot about three perpendicular axes relative to the base member;

a first laterally extending member extending downwardly and in a first lateral direction relative to the ball and socket joint, the first laterally extending member configured to releasably receive and retain a first ballast plate in a position substantially laterally offset from the vertical axis when the first seat or platform is in a centered position;

a second laterally extending member extending downwardly and in a second lateral direction relative to the ball and socket joint, the second laterally extending member configured to releasably receive and retain a second ballast plate in a position substantially laterally offset from the vertical axis when the first seat or platform is in a centered position; and, a second seat or platform positioned below and laterally offset from the first seat and operable to support a user in a seated position when performing a rowing exercise, wherein the first lateral direction is generally opposite the second lateral direction, and wherein the seat or platform is operable to, when in an operative exercise mode, simultaneously pivot and rotate relative to the rigid base member subject to momentum of the first ballast plate and the second ballast plate and further operable to, when in a mount or dismount mode, be locked into position by a locking mechanism.

2. The apparatus of claim 1, further comprising a handle or foot stabilizing member that is adjustable between a first position wherein the stabilizing member serves as a handle bar and a second position wherein the stabilizing member serves as a footrest.

3. The apparatus of claim 1, wherein the second seat or platform remains substantially fixed when the apparatus is in an operative exercise mode.

4. The apparatus of claim 1, further comprising a mechanism to adjust the height of the rigid base member such that the pivot mechanism may be disposed at various operative vertical positions.

5. The apparatus of claim 1, wherein the first seat or platform comprises a platform operable to support a user in a standing position with feet at least shoulder width apart.

* * * * *